United States Patent [19]

Williams

[11] Patent Number: 4,538,637

[45] Date of Patent: Sep. 3, 1985

[54] FREEZE PROOF FAUCET

[76] Inventor: Robert F. Williams, 7505 E. Atherton, Davison, Mich. 48473

[21] Appl. No.: 470,098

[22] Filed: Feb. 28, 1983

[51] Int. Cl.[3] ..... F16L 5/00

[52] U.S. Cl. ..... 137/360; 137/375; 251/82; 251/264; 251/318

[58] Field of Search ..... 137/312, 360, 375; 251/264, 319, 82, 318

[56] References Cited

U.S. PATENT DOCUMENTS

| | | | |
|---|---|---|---|
| 1,369,444 | 2/1921 | Koplin | 251/82 |
| 1,484,740 | 2/1924 | Rubino | 251/264 |
| 1,582,938 | 5/1926 | Smith | 251/83 |
| 4,084,620 | 4/1978 | Bucknell et al. | 137/360 |
| 4,158,366 | 6/1979 | Van Meter | 137/360 |
| 4,244,555 | 1/1981 | Maggioni et al. | 251/82 |
| 4,316,481 | 2/1982 | Fillman | 137/360 |

*Primary Examiner*—A. Michael Chambers
*Assistant Examiner*—Sheri Novack
*Attorney, Agent, or Firm*—Gifford, VanOphem, Sheridan, Sprinkle & Nabozny

[57] ABSTRACT

A freeze proof faucet which is adapted to be mounted to an exterior wall and comprises an elongated tubular housing defining an interior housing chamber. The housing is mounted to the wall and the interior end of the housing is connected to the water supply while an outlet is formed on the housing outside the wall. An elongated valve member is longitudinally slidably mounted within the housing and movable from a closed position, in which one end of the valve member sealingly engages and closes a valve seat adjacent the innermost end of the housing, and an open position in which the valve member permits water to flow from the inlet, through the housing and out through the outlet. A valve actuator is threadably mounted to the housing on its exterior end and includes a pusher surface which cooperates with an abutment surface formed on the valve member. Thus, when the valve actuator is rotated to a closed position, the pusher surface engages the abutment surface and longitudinally slides the valve member to its closed position. Conversely, in its open position, the distance between the pusher surface and the valve seat is greater than the length of the valve member thus permitting the water pressure to force the valve member away from the valve seat and establish fluid flow from the inlet and to the outlet. In the preferred form of the invention, all major components of the faucet are constructed of plastic.

7 Claims, 4 Drawing Figures

FREEZE PROOF FAUCET

BACKGROUND OF THE INVENTION

I. Field of the Invention

The present invention relates to a freeze proof faucet adapted to be mounted to an exterior wall.

II. Description of the Prior Art

There are a number of previously known faucets which are mounted to an exterior wall so that the outlet from the faucet is positioned outside the wall and thus exposed to the elements. In many of these previously known faucets, the valve assembly which opens and closes the faucet is positioned on the exterior side of the wall. Consequently, in cold climates the water contained within the faucet upstream from the valve assembly can freeze and result in damage or even destruction of the faucet.

There have, however, been a number of previously known faucets which are designed specifically to prevent freezing of water within the faucet in cold climates. Such faucets typically comprise an elongated housing which extends inwardly from the exterior surface of the wall so that the inner end of the housing is positioned within a relatively warm zone of the building structure despite cold weather outside. Furthermore, these previously known freeze proof faucets include a valve seat and a valve member positioned closely adjacent the innermost end of the housing. Since the innermost end of the housing is positioned within a relatively warm zone of the building structure, freezing of the water upstream from the valve and valve seat is prevented.

The other or outer end of the valve member for these previously known freeze proof faucets are typically externally threaded and threadably cooperated with internal threads formed in the valve housing adjacent its outermost end. A handle is secured to the outer end so that rotation of the handle simultaneously rotates and axially displaces the valve member between an open and closed position.

The housing as well as the valve member for these previously known freeze proof faucets have typically been constructed of metal, such as brass, and, therefore, are relatively expensive in construction. The construction of the major components of the faucet, and particularly the valve member, from plastic advantageously reduces the overall cost of the valve assembly. It has not been previously possible, however, to construct the valve member from plastic since, due to the elongated length of the valve member in a freeze proof faucet, a plastic valve member tends to bind within the housing after extended use and is unable to withstand the necessary twisting or torsional forces imposed on the valve member.

A still further disadvantage of these previously known metal freeze proof faucets is that metal has a high thermal conductivity. As such, under extremely cold conditions the water can still freeze at the innermost end of the faucet, particularly if there is little or no warm air circulation around the faucet.

SUMMARY OF THE PRESENT INVENTION

The present invention provides a freeze proof plastic faucet which overcomes all of the above-mentioned disadvantages of the previously known devices.

In brief, the faucet of the present invention comprises an elongated tubular housing defining an interior housing chamber. The housing is secured to an exterior wall so that one end of the housing protrudes outwardly from the outer surface of the wall while the other end of the housing is positioned inwardly from the outside of the wall and thus in a warm zone of the building structure. The inner end of the housing is secured by conventional means to a fluid or water supply and the water supply is open through a valve seat to the housing chamber. Similarly the housing includes an outlet at its end outside the wall and the outlet is also open to the housing chamber.

An elongated valve member having a valve face at one end is longitudinally slidably mounted within the housing chamber. The valve member is movable between a closed position in which the valve face abuts against and fluidly closes the valve seat, and an open position in which the valve member is spaced from the valve seat and establishes fluid communication between the inlet and the outlet.

A valve actuator having an externally threaded portion threadably engages an internally threaded portion at the outer end of the housing. A handle is secured to the actuator so that rotation of the actuator simultaneously axially displaces the actuator with respect to the housing between an extended, or open, and a retracted, or closed, position.

A pusher surface is formed at the inner end of the valve actuator and cooperates with an abutment surface formed at the outer end of the valve member. Upon rotation of the valve actuator to its closed position, the pusher surface engages the abutment surface and slidably urges the valve member to its closed position. Conversely, when the valve actuator is rotated to its open position, fluid pressure from the fluid system urges the valve member away from the valve seat thus permitting fluid flow from the inlet, through the housing chamber and out through the housing outlet.

In the preferred form of the invention, all major components of the faucet are constructed of plastic. These major components include the valve housing, valve member, valve actuator and the valve handle.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
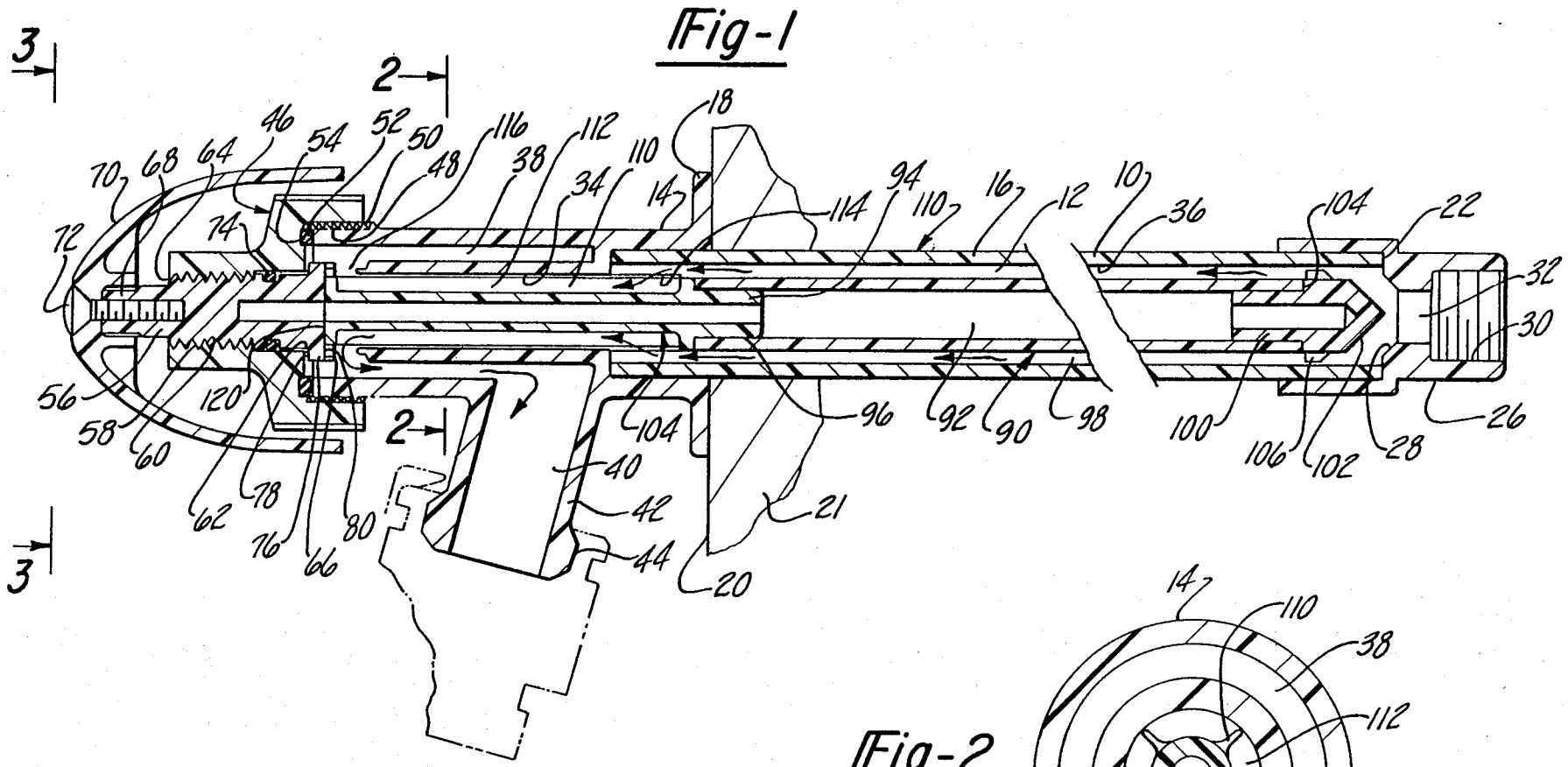
FIG. 1 is a longitudinal sectional view illustrating a preferred embodiment of the faucet of the present invention.

With reference first to FIG. 1, a preferred embodiment of the present invention is thereshown and comprises an elongated tubular and cylindrical housing 10 forming an interior cylindrical housing chamber 12. The housing 10 is preferably constructed from two housing parts 14 and 16 which are constructed of plastic. The housing parts 14 and 16 are coaxially joined together by any conventional means, such as solvent welding.

Figure 3:
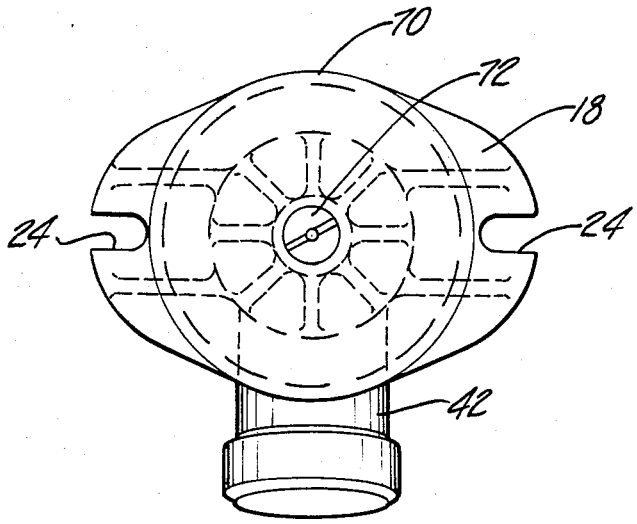
FIG. 3 is an end view taken substantially along line 3—3 in FIG 1.

Referring now to FIGS. 1 and 3, an outwardly extending mounting flange 18 is formed on the first housing part 14 at its junction with the second housing part 16. The flange 18 abuts against an exterior surface 20 of a wall 21 of a building so that the first housing part 14 protrudes exteriorly of the wall surface 20 while the second housing part 16 extends inwardly from the wall surface 20 and has its innermost end 22 positioned within a warm zone of the building. Fastener openings 24 (FIG. 3) are formed in the mounting flange 18 for securing the flange 18, and thus the housing 10, to the wall 21.

Referring again to FIG. 1, a fluid fitting 26 forming a valve seat 28 is secured to the innermost end 22 of the housing 10 by conventional means, such as solvent welding. The fitting 26 includes an internally threaded portion 30 adapted for fluid connection to a fluid system, such as the pressurized water supply of the building, so that the fitting 26 forms an inlet 32 to the valve seat 28 and thus to the housing chamber 12.

Still referring to FIG. 1, the first housing part 14 includes an interior cylindrical wall 34 which is coaxial with but smaller in diameter than a cylindrical wall 36 in the second housing part 16. The walls 34 and 36 together form the housing chamber 12. An annular fluid chamber 38 is formed within the first housing part 14 around the cylindrical wall 34 and is open to an outlet 40 formed in a fluid fitting 42. The fitting 42 extends outwardly from the housing 10 and is externally threaded at its free end 44 for connection to an internally threaded hose connector or the like.

A cap 46 having internal threads 48 threadably engages an externally threaded portion 50 at the free or outer end 52 of the first housing part 14. An annular fluid seal 54 is sandwiched in between the cap 46 and the outer end 52 of the first housing part in order to fluidly seal the cap 46 and first housing part 14 together.

A cylindrical valve actuator 56 having external threads 58 threadably engages an internally threaded axial bore 60 formed in the cap 46. The cap bore 60 is coaxial with the housing 10 and has an inner end 62 open to the housing chamber 12 and an outer end 64 open to the outermost end of the cap 46.

The valve actuator 56 is dimensioned so that an inner end 66 of the actuator 56 is positioned within the housing chamber 12 while its outer end 68 protrudes outwardly from the cap 46. A handle 70 (FIGS. 1 and 3) is secured to the outer end 68 of the actuator 56 by a screw 72 so that rotation of the actuator 56 by the handle 70 axially displaces the actuator 56 due to its threaded connection with the cap 46. A fluid seal 74 is also provided between the actuator 56 and cap bore 60 to prevent fluid leakage along the cap bore 60.

An enlarged diameter portion 76 is formed at the inner end 66 of the actuator 56 which forms an annular abutment surface 78. The abutment surface 78 is larger in diameter than the cap bore 60 and limits the axial outward movement of the acutator 56 in the cap bore 60. In addition, a circular pusher surface 80 is formed at the inner end 66 of the actuator 56 and thus open to the housing chamber 12 for a reason to be subsequently described.

Figure 2:
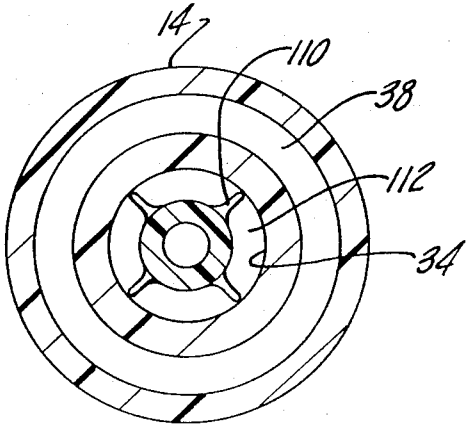
FIG. 2 is a sectional view taken substantially along line 2—2 in FIG. 1.

With reference now to FIGS. 1 and 2, an elongated valve member 90 is longitudinally slidably mounted within the housing chamber 12. The valve member 90 comprises a first valve part 92 and a second valve part 94, both of which are preferably constructed of plastic. Both valve parts 92 and 94 are elongated and are coaxially secured together at a junction 96 by a conventional means, such as solvent welding.

The first valve part 92 is generally cylindrical in shape and has a diameter smaller than the diameter of the housing wall 36 thus forming an annular fluid chamber 98 between the first valve part 92 and the second housing part 16. A valve head 100 having a valve face 102 is secured to the innermost or free end 104 of the first valve member 92. The valve face 102 cooperates with the valve seat 28 so that, with the valve face 102 in abutment with the valve seat 28, the valve head 100 fluidly disconnects the inlet 32 from the housing chamber 12. Circumferentially spaced and radially outwardly extending wings 106 on the valve head 100 maintain the alignment of the valve head 100 coaxial with the valve seat 28.

The second housing part 94 is also elongated and is slidably mounted within the first or outer housing part 14. The second valve part 94 includes a plurality of axially extending and circumferentially spaced flutes 110 formed around its outer periphery which form a plurality of axially extending channels 112 (FIG. 2) between the housing wall 34 and the second valve part 94. The innermost end 114 of each channel 112 is open to the annular chamber 98 in the second housing part 16. Similarly, as shown in FIG. 1, the outermost end 116 of each channel 112 is open to the annular housing chamber 38 and thus to the outlet 40. Consequently, the annular chamber 94, axially extending channels 112 and annular housing chamber 38 together form a fluid passageway between the inlet 32 and the outlet 40.

The fluted second valve part 94 is substantially the same diameter as the housing wall 34. Thus, the second valve part 94 with wings 106 maintains the valve member 90 coaxial with the housing 10.

With reference now particularly to FIG. 1, a circular abutment surface is formed at the outer or free end of the second valve member 94. The circular abutment surface 120 registers with and flatly abuts against the pusher surface 80 formed on the valve actuator 56. Thus, axial displacement of the valve actuator 56 causes the pusher surface 80 to engage the abutment surface 120 and longitudinally move the valve member 90 along the housing chamber 112.

Figure 4:
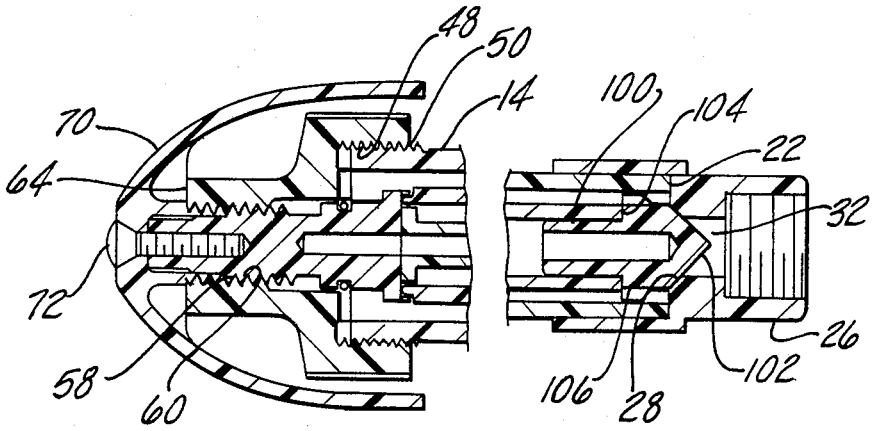
FIG. 4 is a fragmentary sectional view illustrating the faucet in its closed position.

With reference now particularly to FIGS. 1 and 4, rotation of the valve actuator 56 axially displaces the valve actuator 56 between an extended or open position, shown in FIG. 1, and retracted or closed position as shown in FIG. 4. In its open position, the actuator pusher surface 80 is spaced from the valve seat 28 by a distance greater than the length of the valve member 90 thus enabling fluid pressure from the inlet 32 to force the valve member 90 away from the valve seat 28 and againt the valve actuator 56. In doing so, the valve head 100 establishes fluid communication from the inlet 32, through the annular chamber 98, axial channels 112, annular chamber 38 and to the fluid outlet 40.

Conversely, as the actuator 56 is rotated to its closed position (FIG. 4) the actuator pusher surface 80 engages the valve member abutment surface 120 and axially pushes the valve member 90 towards the valve seat 28. When the valve face 102 abuts against the valve seat 28, the valve member 90 fluidly disconnects the inlet 32 from the outlet 40 thus terminating fluid flow between the inlet 32 and outlet 40.

All major components, such as the valve housing 10, valve actuator 56, cap 46 and handle 70 are constructed of plastic which minimizes the cost of the faucet without degrading its peformance.

A still further advantage of the present invention is the provision of the elongated valve member 90 which enables the valve head 100 and valve seat 28 to be positioned interiorly of the wall surface 20 and thus in a warm zone of the building. In addition, plastic has a low thermal conductivity. As such, freezing of the faucet in cold weather is totally eliminated.

Furthermore, since the valve member 90 axially slides within the housing chamber 12, but does not rotate with the actuator 56, the previously known tendancy of plastic valve parts to bind is totally avoided and little or no twisting force is imposed on the valve member 90. Scoring of the valve seat is also eliminated.

Having described my invention, however, many modifications thereto will become apparent to those skilled in the art to which it pertains without deviation from the spirit of the invention as defined by the scope of the appended claims.

I claim:

1. A faucet adapted to be mounted to a wall having an exterior surface comprising:

an elongated tubular plastic housing defining an interior housing chamber, one end of said housing chamber open to a fluid inlet and a fluid outlet open to said housing chamber adjacent the other end of said housing, said fluid inlet open to a valve seat, closely adjacent said one end of said housing chamber, means for mounting said housing to the wall so that said one housing end extends inwardly from said exterior surface of the wall and said other housing end extends outwardly from the exterior surface of the wall, an elongated plastic valve member having a valve face at one end and an abutment surface at its other end, said valve member being longitudinally slidably mounted in said housing chamber between a closed position in which said valve face abuts against and closes said valve seat, and an open position in which said valve face is spaced from said valve seat, and a plastic valve actuator having a pusher surface, means for mounting said valve actuator to the other end of said housing so that said valve actuator is movable between an axially retracted position in which said pusher surface engages said abutment surface and urges said valve face against said valve seat, and an axially extended position in which said pusher surface is spaced from said valve seat by a distance greater than the length of said valve member, said valve member and said actuator being free to move longitudinally with respect to each other when said valve actuator is in said extended position, wherein said valve member is dimensioned so that said pusher and abutment surfaces are spaced outwardly from said exterior wall surface.

2. The invention as defined in claim 1 wherein said actuator includes a threaded portion which threadably cooperates with a threaded portion at said other end of said housing.

3. The invention as defined in claim 2 and including a handle secured to said actuator for manually rotating said actuator.

4. The invention as defined in claim 1 wherein said valve member comprises a cylindrical part and an axially adjacent fluted part, said cylindrical part forming an annular chamber in said housing chamber, said fluted part forming a plurality of axially extending and circumferentially spaced channels in said housing chamber, wherein said annular chamber and said channels form a fluid passage means between said inlet and said outlet and wherein each flute includes an outer edge which engages said housing and maintains said valve member coaxial with said housing as said valve member moves between said open and said closed positions.

5. The invention as defined in claim 1 wherein an inner end of said fluted part is open to said annular chamber, said housing comprising a further annular chamber open to said outlet, and wherein an outer end of said fluted part is open to said further annular chamber.

6. The invention as defined in claim 1 wherein said housing comprises a first part and a second part and means for coaxially securing said parts together.

7. The invention as defined in claim 1 wherein said valve actuator pusher surface is spaced outwardly from said wall exterior surface by a distance greater than the spacing between said fluid outlet and said wall exterior surface.

* * * * *

UNITED STATES PATENT AND TRADEMARK OFFICE

CERTIFICATE OF CORRECTION

PATENT NO. : 4,538,637

DATED : Sept. 3, 1985

INVENTOR(S) : Robert F. Williams

It is certified that error appears in the above–identified patent and that said Letters Patent are hereby corrected as shown below:

Column 4, line 37, after "94" insert --together--.

Signed and Sealed this

Eighteenth Day of November, 1986

*Attest:*

DONALD J. QUIGG

*Attesting Officer* *Commissioner of Patents and Trademarks*